United States Patent [19]

Socci

[11] Patent Number: 4,826,165

[45] Date of Patent: May 2, 1989

[54] BATTING CHIN SHOULDER HARNESS

[76] Inventor: Roger Socci, 700 Bannock Ct., Palm Beach Gardens, Fla. 33418

[21] Appl. No.: 125,930

[22] Filed: Nov. 27, 1987

[51] Int. Cl.[4] ..... A63B 69/40

[52] U.S. Cl. ..... 273/26 R; 273/190 C

[58] Field of Search ..... 273/26 C, 188 R, 190 R, 273/190 A, 190 C, 191 A, 87 B, 26 A, 183 B; 272/80; D16/107, 110; 434/247

[56] References Cited

U.S. PATENT DOCUMENTS 3,779,549 12/1973 MacNeil ..... 273/190 C 4,300,765 11/1981 Stringham ..... 273/190 C 4,605,226 8/1986 Morrissey ..... 273/26 C

*Primary Examiner*—Richard C. Pinkham

*Assistant Examiner*—T. Brown

*Attorney, Agent, or Firm*—Sam D. Walker

[57] ABSTRACT

The present invention is concerned with a training device for hitting a baseball comprising a shoulder harness with a chin holder connected thereto in a manner to allow for movement of the chin holder on a plane from the right shoulder to the left shoulder in an elliptical fashion.

1 Claim, 1 Drawing Sheet

BATTING CHIN SHOULDER HARNESS

FIELD OF THE INVENTION

The present invention relates to a hitting aid. More particularly, the present invention relates to a chin-shoulder harness as a training and teaching device for hitting a baseball.

BACKGROUND OF THE INVENTION

Numerous techniques have been developed to improve the ability of a player to hit a ball with a bat, club, racket or other implement. Generally, these techniques rely upon a repetitive practice routine of swinging at the ball. In the case of base-ball players, batting tees, batting practice machine and pitchers have been used to improve a batter's swing and hitting ability. While these techniques have been useful, the degree of success with all players has not been particularly great. Further, relatively long periods of time are required with proper instructions to perfect one's ability through constant practice.

Numerous articles have also been published on methods for improving hitting. For example, *THE ART OF HITTING* by Charley Lau with Alfred Glossbrenner (1980) discloses the movement of the head during hitting. *THE SWING'S THE THING* by Ben Hines and Bob McBee (1985) teaches chin and shoulder movement, the fulcrum position, bringing the barrel of the bat in a downward plane into the baseball, and the turning of the head.

It has been well established in the art that proper head to shoulder transfer and movement through the swing is critical in achieving solid contact with the ball in transferring maximum force so as to hit the ball as far as possible. U.S. Pat No. 4,605,226 by Morrissey discloses a training device to be used in the sport of baseball and the like which enables the user to improve his hand-eye coordination and to maximize his physical power by maximizing the head to shoulder transfer. The device of Morrissey is mounted on a protective helmet said device comprising a shield having a top flange and a main opaque body releasably mounted on a protective helmet on the side opposite the source of the projectile travelling towards the user. In the case of baseball, the user's head being out of the desired position will result in a shielding of the eyes of the user from the projectile.

U.S. Pat. No. 4,300,765 by Stringham discloses a batting aid which is comprised of a shoulder piece for positioning on a shoulder of a batter, a jaw piece for positioning against the jaw of the batter and means which connects the shoulder piece and jaw piece together in a spaced relation to each other in order to impede movement of the jaw of the batter towards the shoulder during a swing.

Continual efforts to correct head movement in the process of hitting a pitched baseball is common place.

It is therefore, an object of the present invention to provide a relatively simple device to improve the hitting ability of the batter.

Another object of the present invention is to provide a batting aid for a baseball player which will enable the batter to keep his head in the correct position and the proper use of his front shoulder in the hitting process.

A further object of the present invention is to provide a simple hitting device which can improve the hitting stance of a batter.

These and other objects of the present invention will become more apparent as you proceed through the detailed description.

SUMMARY OF THE INVENTION

The present invention is concerned with a training device for hitting a baseball comprising, a contoured shoulder harness which sits on the shoulder of the hitter like a football shoulder pad; a chin holder which is positioned on the shoulder harness to accept the chin; means for connecting the shoulder harness to the chin holder in spatial relationship to each other in a manner to allow for movement of the chin holder on a plane along the shoulder harness, said movement resulting from train-like tracks running from the right shoulder to the left shoulder in an elliptical fashion.

DETAILED DESCRIPTION

Figure 1:
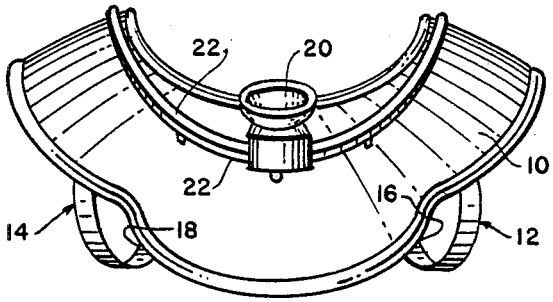
FIG. 1 is a front view of the shoulder harness with chin holder and straps for anchoring to harness to the user.
Figure 2:
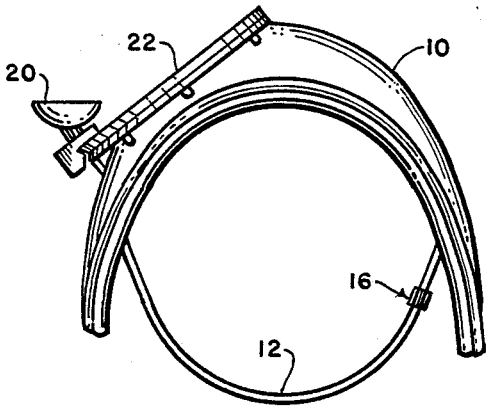
FIG. 2 is a side view of the shoulder harness further illustrating the train-like track and the means for connecting the chin holder and the shoulder harness.
Figure 3:
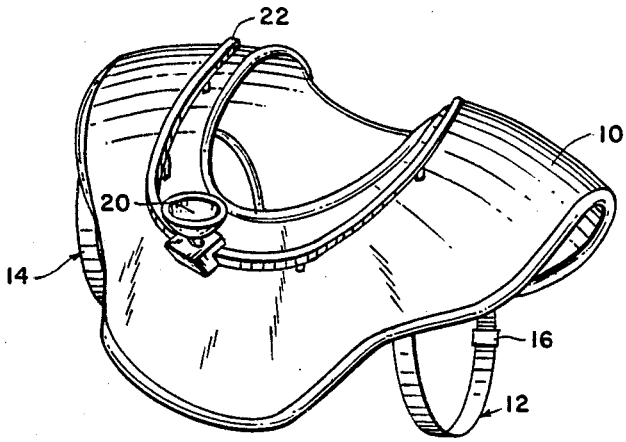
FIG. 3 is a perspective view of the hitting device.

The present invention discloses a teaching and training tool for demonstrating a baseball player's proper head movement during the process of hitting a pitched ball.

In addition to training the correct head movement during the process of hitting a pitched ball, the present invention further inadvertently teaches and trains the proper use of a batter's front shoulder in the hitting process.

The first feature of the present invention is a shoulder harness which is positioned on the shoulder of the hitter like a football shoulder pads. The batter puts the shoulder harness on like a football player puts on shoulder pads. The harness sits on the shoulder much like a football shoulder pads.

The shoulder harness may be made from leather or plastics with padding in areas which directly contacts the shoulder to minimize discomfort during use. To secure the shoulder harness to the batter, two strap-like security means each connected on the underside of the shoulder harness surrounding the shoulder—arm area. Attached to the strap-like means are adjustment means designed to accommodate different shoulder sizes.

Connected to the shoulder harness is a chin holder which is positioned on the harness to accept the chip. The chin holder is connected to the shoulder harness in spatial relationship to each other in a manner to allow for movement of the chin holder on a plane along the shoulder harness, said movement resulting from a train-like track running from the right shoulder to the left shoulder in an elliptical fashion.

During use, the batter puts his chin into the chin holder. During the swinging process the batter's head, held by the chin holder, which minimizes any unnecessary side-to-side movement or head bobbing, moves in the correct way along the track which travels in an elliptical fashion from front to rear. Before the next pitch the batter slides the chin holder back to the front and repeats the process.

If a batter makes an incorrect head movement during the swing process, one or both eyes will lose sight of the pitched ball, drastically cutting down on the effectiveness of the hitter. During the preparatory stance, the batter's head and chin should be on his front shoulder. The head and chin should move down on the swing and up o or finish on his rear shoulder after the swing. The head of the batter should never stay on the front shoulder, in the vicinity of the front shoulder, nor move over the front shoulder during the swing. The downward movement of the head during the swing enables the batter's eyes always to be in the back of the ball where they can focus and track the ball until it contacts the bat. The device of the present invention allows for correct head, shoulder and eye movement which enhances contact of the bat and the ball.

What is claimed is:

1. A training device for hitting a baseball comprising:

a contoured shoulder harness which sits on the shoulder of the hitter like a football shoulder pad;

a chin holder which is positioned on the shoulder harness to accept the chin;

means for connecting the shoulder harness to the chin holder is spatial relationship to one another in a manner to allow for movement of the chin holder on a plane along the shoulder harness, said movement resulting from train-like tracks connected to and running from the right shoulder to the left shoulder on the shoulder harness in an elliptical fashion.

* * * * *